US006464458B2

(12) United States Patent
Vild et al.

(10) Patent No.: US 6,464,458 B2
(45) **Date of Patent: *Oct. 15, 2002**

(54) MOLTEN METAL IMPELLER

(75) Inventors: Chris T. Vild, Cleveland Heights, OH (US); Mark A. Bright, Maple Heights, OH (US)

(73) Assignee: Metaullics Systems Co., L.P., Solon, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/842,538

(22) Filed: Apr. 25, 2001

(65) Prior Publication Data

US 2001/0028846 A1 Oct. 11, 2001

Related U.S. Application Data

(63) Continuation of application No. 09/056,409, filed on Apr. 8, 1998, now Pat. No. 6,254,340, which is a continuation-in-part of application No. 08/842,004, filed on Apr. 23, 1997, now Pat. No. 5,785,494.

(51) Int. Cl.[7] ..... F04D 7/06

(52) U.S. Cl. ..... 415/200; 415/206; 416/181; 416/182; 416/241 B

(58) Field of Search ..... 415/200, 206, 415/90; 416/179, 181, 182, 185, 186 R, 223 B, 241 B; 266/235, 239

(56) References Cited

U.S. PATENT DOCUMENTS

| | | | | |
|---|---|---|---|---|
| 1,865,918 A | | 7/1932 | Junkers | |
| 2,276,404 A | | 3/1942 | Lundquist | |
| 2,320,663 A | | 6/1943 | Schultz | |
| 2,472,412 A | | 6/1949 | Fritz | |
| 2,948,524 A | | 8/1960 | Sweeney et al. | |
| 3,048,384 A | | 8/1962 | Sweeney et al. | |
| 4,426,068 A | | 1/1984 | Gimond et al. | |
| 5,088,893 A | | 2/1992 | Gilbert et al. | |
| 5,180,280 A | | 1/1993 | Honda | |
| 5,330,328 A | | 7/1994 | Cooper | |
| 5,540,550 A | | 7/1996 | Kubota | |
| 5,785,494 A | | 7/1998 | Vild et al. | |
| 6,254,340 B1 | * | 7/2001 | Vild et al. | 415/200 |

FOREIGN PATENT DOCUMENTS

| | | | | |
|---|---|---|---|---|
| GB | 574079 | | 12/1945 | |
| GB | 691656 A | * | 5/1953 | 416/223 B |
| GB | 789674 | | 1/1968 | |
| SU | 687262 A | * | 9/1979 | 416/179 |

* cited by examiner

*Primary Examiner*—Christopher Verdier
(74) *Attorney, Agent, or Firm*—Fay, Sharpe, Fagan, Minnich & McKee, LLP

(57) ABSTRACT

An impeller for a molten metal pump having a cylindrical body comprised of a refractory material. The cylindrical body includes generally coplanar top and bottom surfaces. A central bore is provided in the top surface to provide a point for mating with a shaft. A plurality of circumferentially spaced passages extend from the top or bottom surface to a side wall of the impeller, each of the passages being separate and preferably having an inlet opening which is equal to or less than the corresponding outlet opening in size. A recess being optionally formed in the top or bottom surface, forming the initial inlet to the passages.

14 Claims, 8 Drawing Sheets

MOLTEN METAL IMPELLER

This application is a continuation of U.S. patent application Ser. No. 09/056,409, filed Apr. 8, 1998, now U.S. Pat. No. 6,254,340, which is a continuation-in-part of U.S. patent application Ser. No. 08/842,004, filed Apr. 23, 1997, now U.S. Pat. No. 5,785,494.

BACKGROUND OF THE INVENTION

This invention relates to molten metal pumps. More particularly, this invention relates to an impeller suited for use in a molten metal pump. The impeller of the present invention is particularly well suited to be used in molten aluminum and molten zinc pumps. In fact, throughout the specification, numerous references will be made to the use of the impeller in molten aluminum pumps, and certain prior art molten aluminum pumps will be discussed. However, it should be realized that the invention can be used in any pump utilized in refining or casting molten metals.

In the processing of molten metals, it is often necessary to move molten metal from one place to another. When it is desired to remove molten metal from a vessel, a so called transfer pump is used. When it is desired to circulate molten metal within a vessel, a so called circulation pump is used. When it is desired to purify molten metal disposed within a vessel, a so called gas injection pump is used. In each of these types of pumps, a rotatable impeller is disposed within a pumping chamber in a vessel containing the molten metal. Rotation of the impeller within the pumping chamber draws in molten metal and expels it in a direction governed by the design of the pumping chamber.

In each of the above referenced pumps, the pumping chamber is formed in a base member which is suspended within the molten metal by support posts or other means. The impeller is supported for rotation in the base member by means of a rotatable shaft connected to a drive motor located atop a platform which is also supported by the posts.

Molten metal pump designers are generally concerned with efficiency, effectiveness and longevity. For a given diameter impeller, efficiency is defined by the work output of the pump divided by the work input of the motor. An equally important quality of effectiveness is defined as molten metal flow per impeller revolutions per minute.

A particularly troublesome aspect of molten metal pump operation is the degradation of the impeller. Moreover, to operate in a high temperature, reactive molten metal environment, a refractory or graphite material is used from which to construct the impeller. However, these materials are also prone to degradation when exposed to particles entrained in the molten metal. More specifically, the molten metal may include pieces of the refractory lining of the molten metal furnace, undesirables from the metal feed stock and occlusions which develop via chemical reaction, all of which can cause damage to an impeller and pump housing if passed therethrough.

With regard to earlier impeller designs, U.S. Pat. No. 3,048,384, herein incorporated by reference, displays a molten metal pump with a cup-like impeller having lateral openings in the sidewall for moving molten metal. Although the impeller of this design adequately pumps molten metal, it is prone to clogging when particles are drawn into the pump. More specifically, because the inlet to the impeller makes up the entire central top surface area and extends downwardly the entire depth of the radial openings to the circular base, large particles can enter the impeller but cannot exit through the smaller radial openings.

Accordingly, a risk for catastrophic failure of the pump results if a large particle is jammed against the volute or the pumping chamber. In addition, small particles can slowly clog the radial openings and degrade the performance of the impeller by reducing the volume of molten metal that can be transferred.

In U.S. Pat. No. 5,586,863, a significantly improved molten metal impeller design is provided. More specifically, an impeller comprised of a spherical base, a central hub and radially directed vanes is described. This design achieves a significant advantage by providing a smaller inlet area than outlet area, which more readily passes particles without jamming and/or clogging. However, this design is slightly disadvantaged in that molten metal flow between adjacent vanes is difficult to control.

Accordingly, an impeller having low clogging characteristics, yet also providing high effectiveness would be highly desirable in the art. The current invention achieves these objectives. Moreover, the current invention achieves a number of advantages in directional forced metal flow. For example, the impeller of the current pump is not prone to clogging as in many of the prior impellers. Accordingly, catastrophic failure is much less likely to occur and the effectiveness of operation does not degrade rapidly over time. The design also achieves high strength by increasing the percentage of the body comprised of the refractory material. Furthermore, the impeller design can be prepared with relatively simple manufacturing processes. Therefore, the cost of production is low and accommodates a wide selection of materials, such as graphite or ceramics.

SUMMARY OF THE INVENTION

It is the primary object of this invention to provide a new and improved molten metal pump. It is a further object of this invention to provide a new and improved impeller for use in a molten metal pump.

To achieve the foregoing objects and in accordance with the purpose of the invention as embodied and broadly described herein, the molten metal pump of this invention comprises a motor having an elongated drive shaft with first and second ends. The first end mates with the motor and the second end is attached to an impeller disposed in a pumping chamber. The impeller is comprised of a cylindrical body of a refractory material and includes generally coplanar top and bottom surfaces, with a first central bore in the top surface that mates with the shaft. A plurality of circumferentially spaced passages extend from the top surface to a sidewall of the impeller. Each of the passages provides a separate duct from an inlet opening at the top surface to an outlet opening at the sidewall.

In addition, preferably each inlet opening has a cross-sectional area which is the same as or less than it's corresponding outlet opening. In a further preferred embodiment, the impeller is comprised of graphite. In a particularly preferred form, the impeller includes at least two passages, and more preferably six passages. Preferably, the impeller is provided with a bearing ring surrounding the edge of the bottom surface. In a further preferred embodiment, the top surface of the impeller is formed of a ceramic material and the body of the impeller is graphite.

In an alternative form of the invention, the impeller has a cylindrical graphite or ceramic body with opposed top and bottom surfaces and a radial sidewall. An annular recess is formed in the top or bottom surface, creating an outer ring and inner column. In a top feed embodiment a bore is formed in the inner column to accommodate a shaft. Preferably, the annular recess will extend to a depth between one-half the width of the recess and less than two-thirds, more preferably one half the overall height of the impeller body. In a particularly preferred embodiment, the width and depth of the annular recess are approximately equal. A plurality of passages extend from the sidewall and intersect the annular recess. Preferably, the passages have a height and a width greater than the dimension of the recess radially between the inner column and the outer ring. In this regard, any object or inclusion in the molten metal bath which is sufficiently small to enter the annular recess, will be easily passed through and out the passages in the sidewall.

In a preferred embodiment, the impeller will include four and more preferably six passages with a major portion of the passages disposed at a level below the annular recess, wherein the annular recess intersects only the top region of the passages. For example, the annular recess will extend through the top half of the impeller height and the passages will be located predominantly in the lower half of the impeller height.

In a particularly preferred form of the invention, a ceramic cap member will be secured to the top outer ring of the impeller to protect the top surface and a bearing ring will be secured to the outer lower edge. This form of the impeller has been found to effectively repel large objects in the molten metal bath away from the entry to the impeller, i.e., the annular recess, without significant damage to the impeller or pump housing.

In an additional alternative embodiment, the impeller will include passages which are substantially straight bores passing from the top or bottom surface of the impeller to the sidewall. Preferably the bores will be generally circular or oval in cross-section and will be angled at least 5° and more preferably about 45° from vertical. Preferably, the bores will widen from the inlet to the outlet. Furthermore, this straight bore embodiment can be combined with an annular recess, wherein each bore opens into the recess rather than the top or bottom surface.

DETAILED DESCRIPTION OF THE INVENTION

Reference will now be made in detail to the present preferred embodiment of the invention, an example of which is illustrated in the accompanying drawings. While the invention will be described in connection with the preferred embodiment, it will be understood that it is not intended to limit the invention to that embodiment. On the contrary, it is intended to cover all alternatives, modifications and equivalents that may be included within the spirit and scope of the invention defined by the appended claims.

This invention is directed to a new and improved impeller for use in molten metal pumps. In particular, the impeller is utilized in molten metal pumps to create a forced directional flow of molten zinc or molten aluminum. U.S. Pat. Nos. 2,948,524; 5,078,572, 5,088,893; 5,330,328; 5,308,045 and 5,470,201, herein incorporated by reference, describe a variety of molten metal pumps and environments in which the present impeller could be used.

Figure 2:
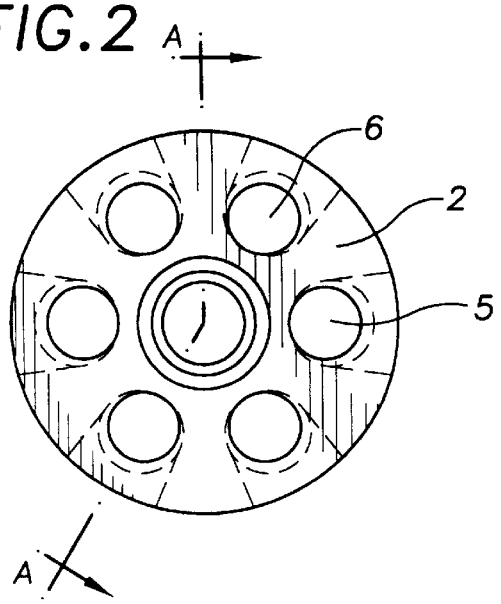
FIG. 2 is a top view of the inventive impeller, showing the passages in cross section.
Figure 1:
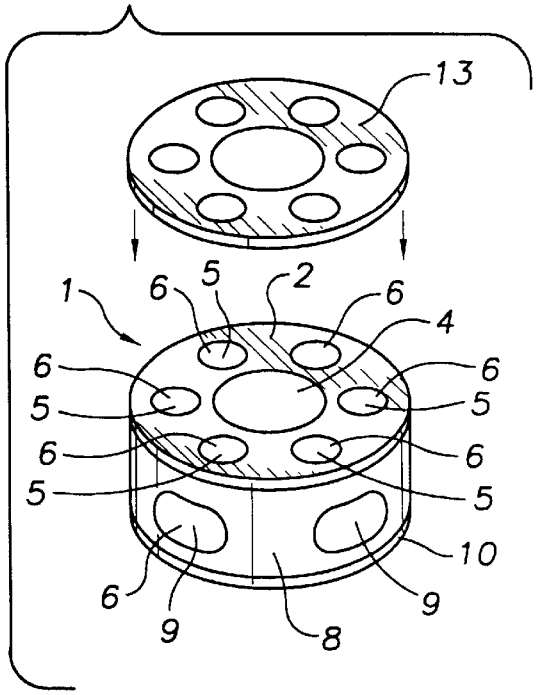
FIG. 1 is a perspective view of the inventive impeller.
Figure 2A:
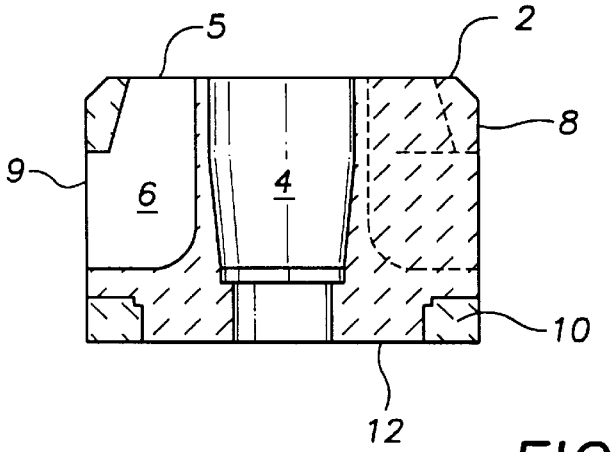
FIG. 2A is a cross sectional view taken along lines A—A in FIG. 2.

Referring now to FIGS. 1, 2 and 2A, the inventive impeller 1 is a generally cylindrical shaped body of graphite or ceramic and includes an upper face 2 having a recess 4 to accommodate a shaft. The upper face 2 also includes inlets 5 to passages 6 which extend downwardly from the upper face and outwardly through a sidewall 8, to an outlet 9. A bearing ring 10 of a ceramic, such as silicon carbide, is provided surrounding the outer edge of a lower face 12. FIG. 1 also shows an optional ceramic cap 13, which can be cemented to the top surface 2 of the impeller 1 to improve the wear characteristics of the device. With specific reference to FIGS. 2 and 2A, the passages 6 increase in diameter from the inlet 5 to the outlet 9. In this manner, any particle which can enter the impeller will also exit.

Figure 4:
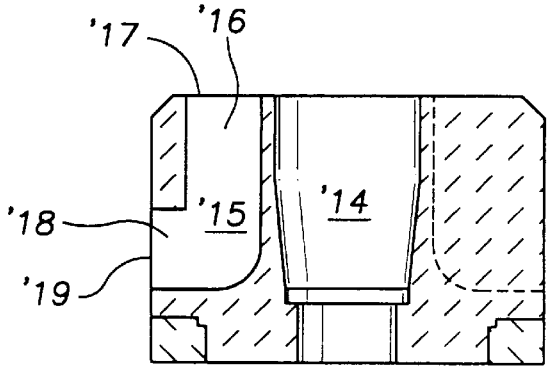
FIG. 4 is a cross-sectional view similar to that of FIGS. 2A, and 3A, of an alternative embodiment of the inventive impeller.
Figure 3:
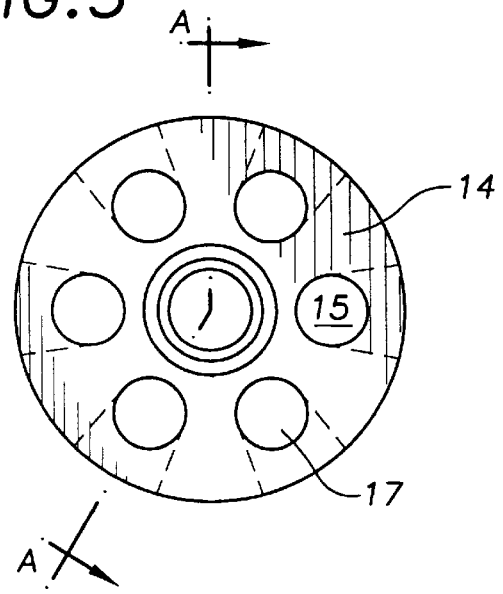
FIG. 3 is a top view of alternative embodiment of the inventive impeller.
Figure 3A:
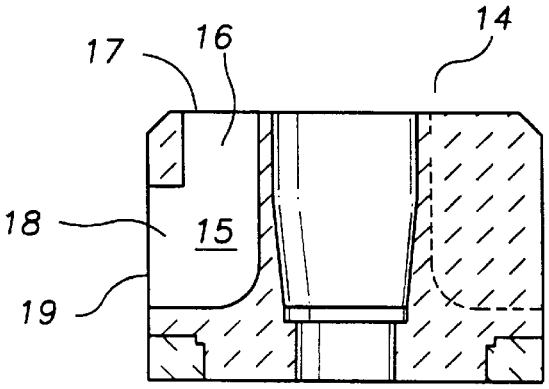
FIG. 3A is a cross sectional view taken along lines A—A in FIG. 3.

FIGS. 3, 3A, and 4 depict an alternative embodiment of the impeller. Particularly, in FIGS. 2 and 2A, the passages have an increasing diameter throughout their length. In contrast, the impeller 14 of FIGS. 3 and 3A includes passages 15 having a first diameter portion in a downward direction 16 and a second wider diameter portion 18 in an outward direction. Nonetheless, an inlet 17 has a smaller diameter than an outlet 19.

FIG. 4 shows an impeller '14 wherein an inlet '17 and an outlet '19 have equivalent cross-sectional areas. Furthermore, the cross-sectional area of passages '15 are substantially equivalent in both the vertical component '16 and the horizontal component '18. Nonetheless, absent any constriction of the flow path, the passages provide a "tunnel" which will accommodate the flow-through of any particle which can fit into the inlet.

Figure 5:
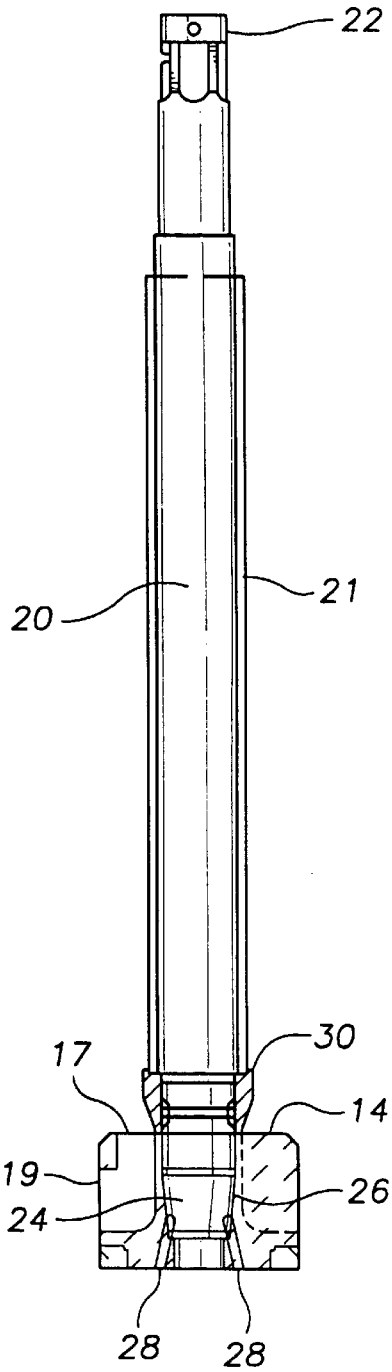
FIG. 5 is a side elevation view of the inventive impeller secured to a drive shaft, partially in cross section.

FIG. 5 is included to depict the inventive impeller 14 attached to a shaft 20. The shaft 20 is substantially encased in a protective sheath 21, and includes a first end 22 which mates with a drive motor (see FIG. 5). The second end includes a tapered portion 24 which mates with the tapered walls of a central bore 26 in the impeller 14. The shaft is secured in the bore 26 by cement (not shown) and several dowels 28. A bearing ring 30 is also positioned on the shaft—cemented in place—to provide a wear surface.

Figure 6:
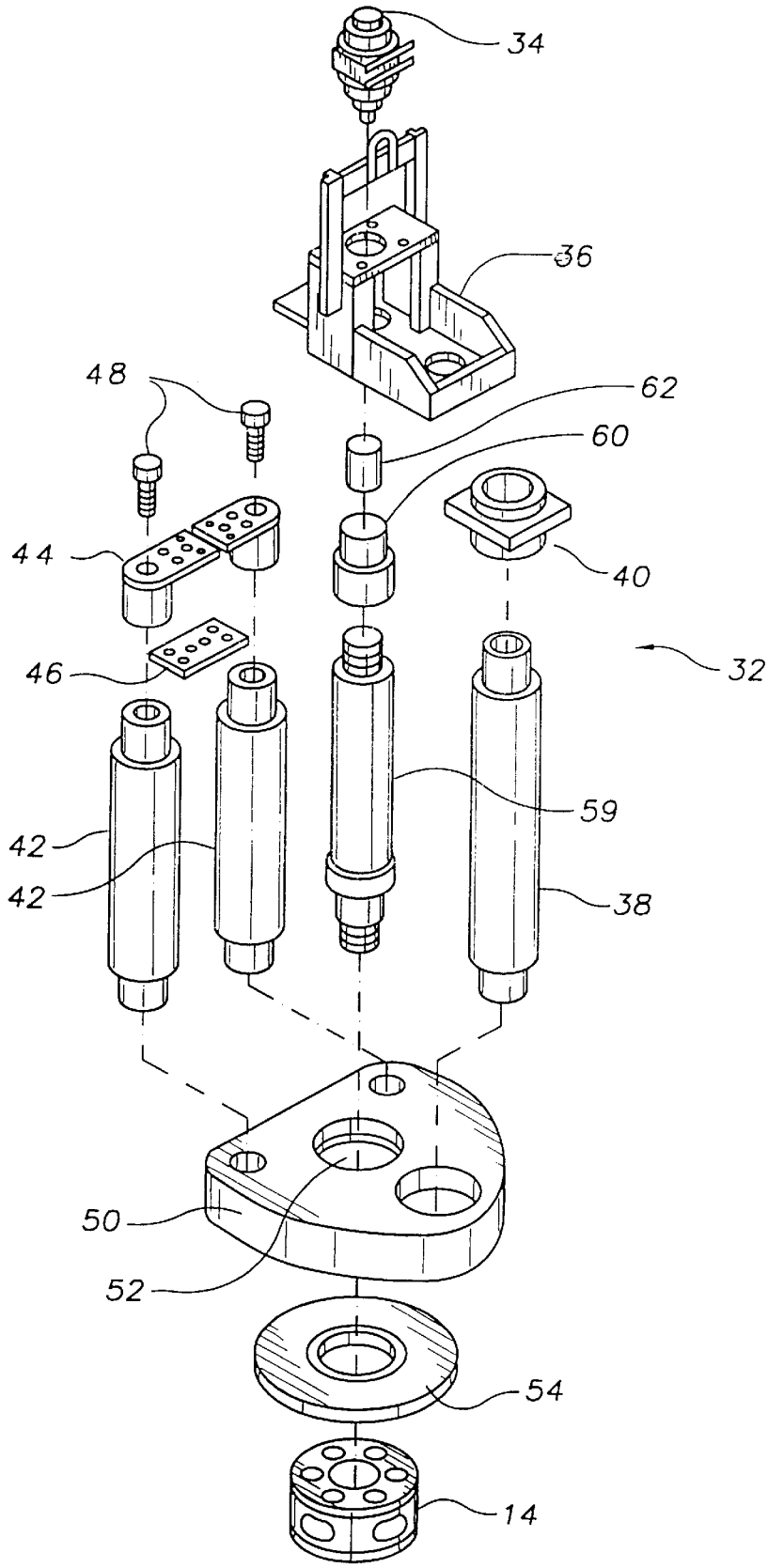
FIG. 6 is an exploded view of a molten metal pump including the inventive impeller.
Figure 7:
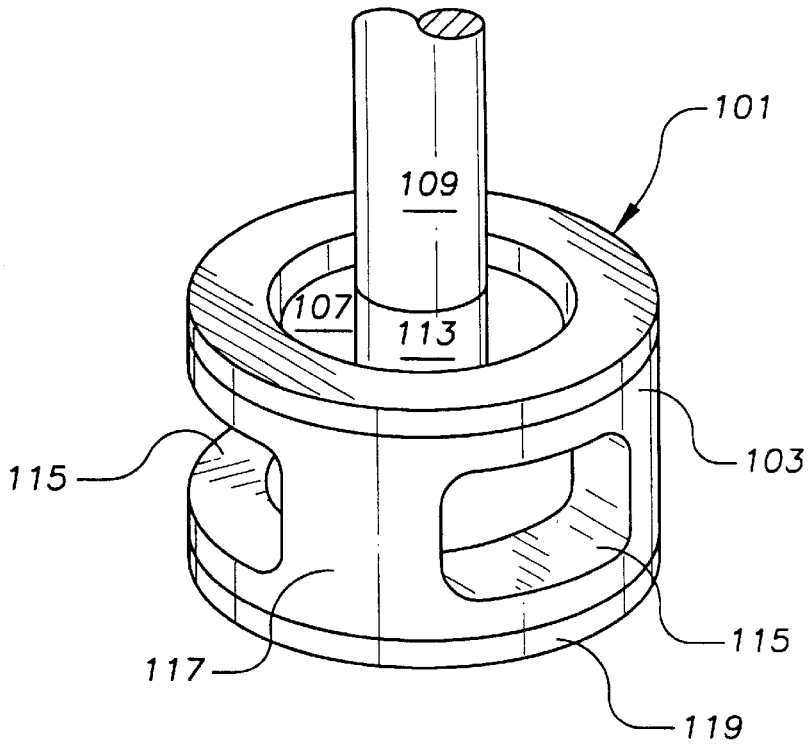
FIG. 7 is a perspective view of an alternative embodiment of the inventive impeller.
Figure 8:
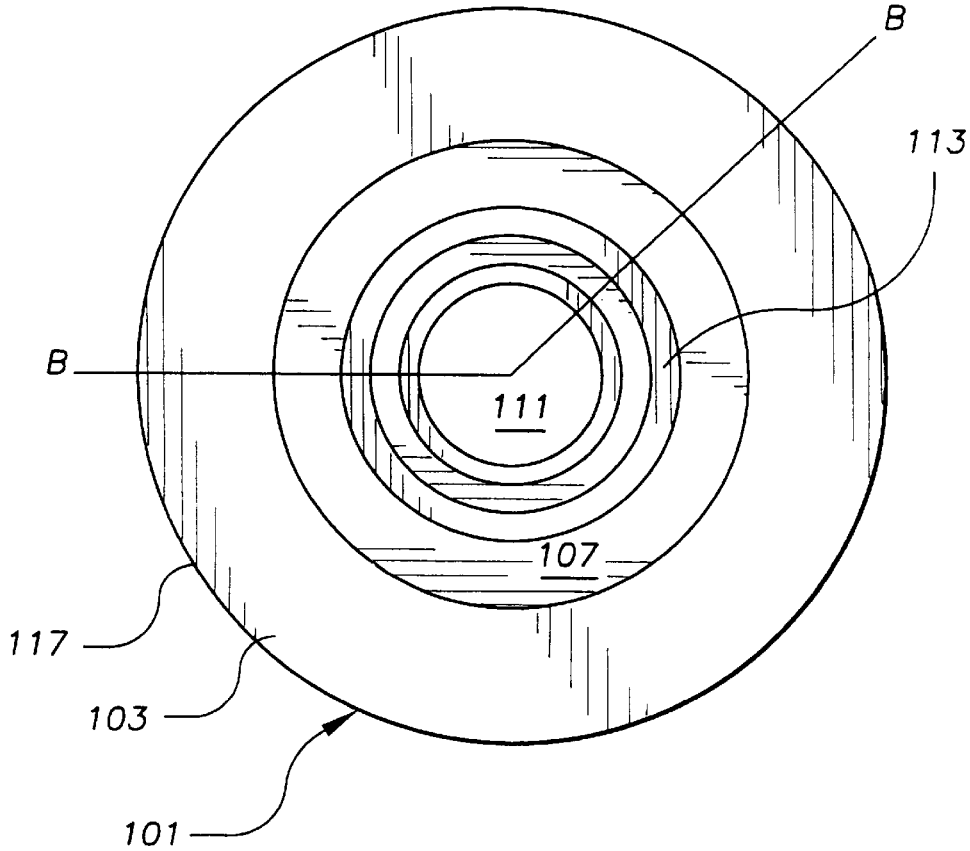
FIG. 8 is a top view of the inventive impeller of FIG. 7 (shaft removed)
Figure 9:
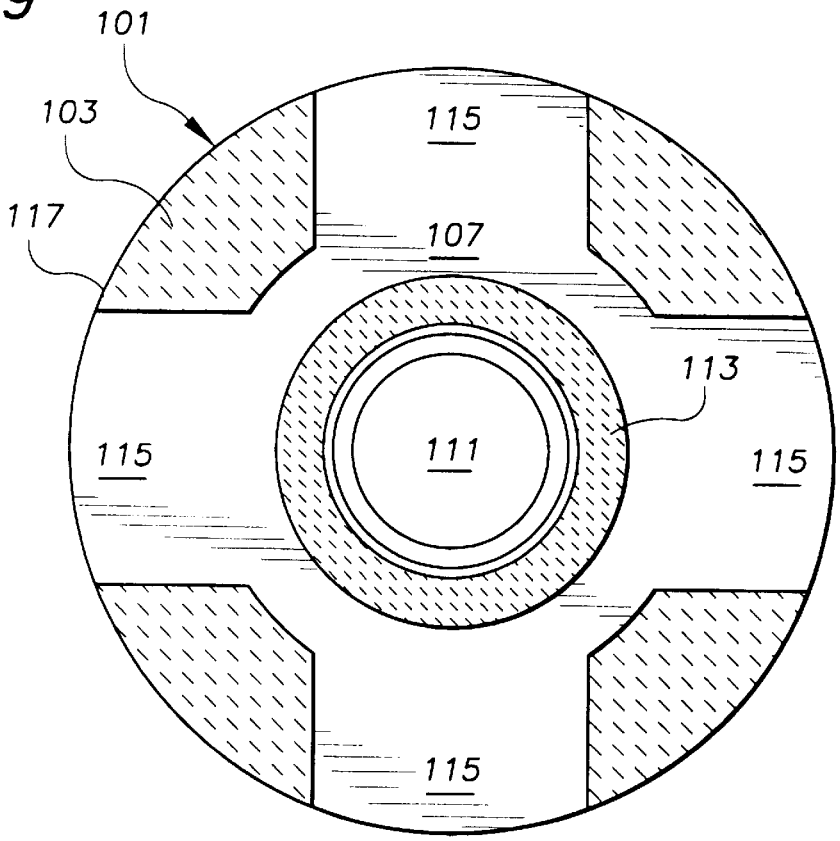
FIG. 9 is a cross-sectional view of the inventive impeller of FIG. 8.
Figure 10:
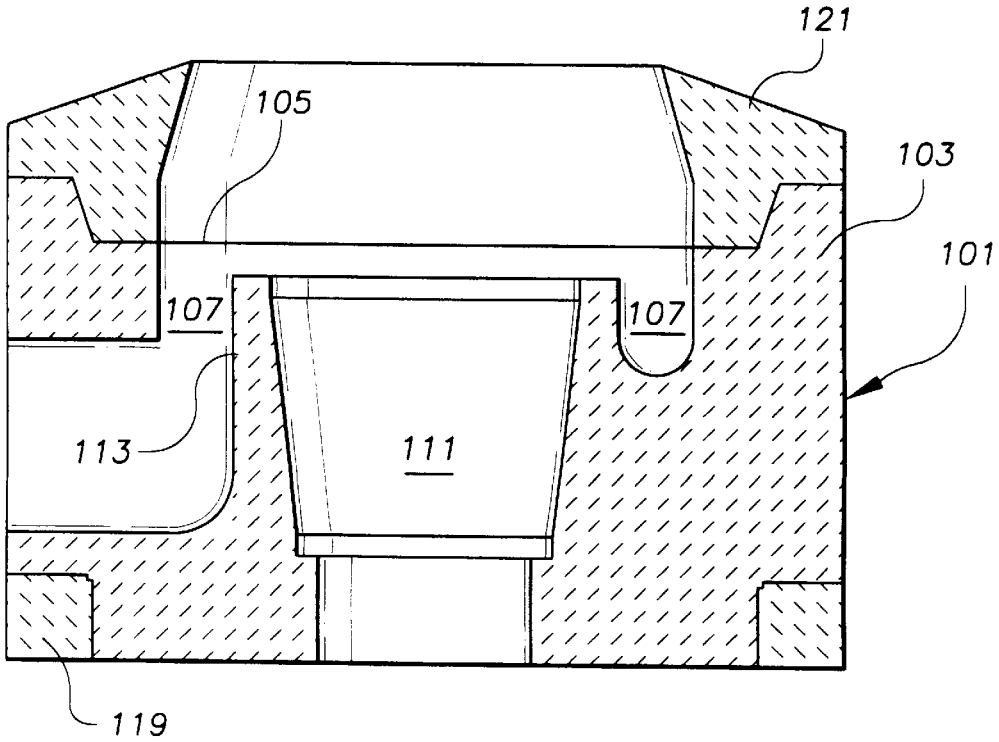
FIG. 10 is a cross-section of the impeller of FIG. 8 taken along lines B—B.

FIG. 6 depicts the arrangement of the impeller 14 in a molten metal pump 32. Particularly, a motor 34, is secured to a motor mount 36. A riser 38 (indicating this pump to be a transfer-style)through which molten metal is pumped is provided. The riser 38 is attached to the motor mount 36 via a riser socket 40. A pair of refractory posts 42 are secured by a corresponding pair of post sockets 44, a rear support plate 46 and bolts 48 to the motor mount 36. At a second end, each of the posts 42, and the riser 38, are cemented into a base 50. The base 50 includes a pumping chamber 52, in which the impeller 14 is disposed. The pumping chamber is constructed such that the impeller bearing ring 10 is adjacent the base bearing ring 54. The impeller is rotated within the pumping chamber via a shaft 59 secured to the motor by a threaded connection 60 pinned to a universal joint 62. Of course, the skilled artisan is aware of many various coupling designs such as, but not limited to, pinned connections and quadralobal drives which are all suitable for use in the present pump.

The novel impeller has a generally cylindrical shape and is formed of a refractory material such as graphite or a ceramic such as silicon carbide. The cylindrical piece includes a cavity in its upper face suitable to accommodate a shaft. The shaft, in turn, is joined to a motor to achieve rotation of the impeller. The periphery of the upper face is machined to include a plurality of passages which extend downwardly and outwardly from the upper face to the sides of the cylindrical impeller. In the preferred embodiment, six passages are formed and provide a large fluid volume area.

Importantly, the passages are formed such that they provide a "tunnel" at the upper face of the impeller which effectively provides entrainment of any particular particles entering the impeller and prevents lodging/jamming between the rotating impeller body and the pump casing. Moreover, any inclusions which are too large to enter the passage will be thrown clear of the pump by centrifugal force, preventing catastrophic failure of the pump. Furthermore, in the preferred embodiment of the impeller, any inclusions or scrap contained in the molten metal which is small enough to enter this dimension of the passage will of necessity be sized such that it can exit the impeller.

Referring now to FIGS. 7–12, an alternative embodiment of the inventive impeller is depicted. In this regard, the impeller 101 again includes a main body 103 having a generally cylindrical shape. The cylindrical main body 103 includes a top surface 105 in which an annular recess 107 is formed. A shaft 109 is secured within bore 111 formed within centrally located column 113, itself formed by annular recess 107. Four passages 115 enter from radial side wall 117 and intersect the annular recess 107. In this manner a plurality of passages are formed from the top surface 105 to the radial sidewall 117.

In a particularly preferred embodiment, the impeller 101 includes a bearing ring 119 and a cap member 121 (see FIG. 12), each comprised of a refractory, high strength material which protects the graphite or ceramic main body 103 from wear, e.g. silicon carbide.

Figure 11:
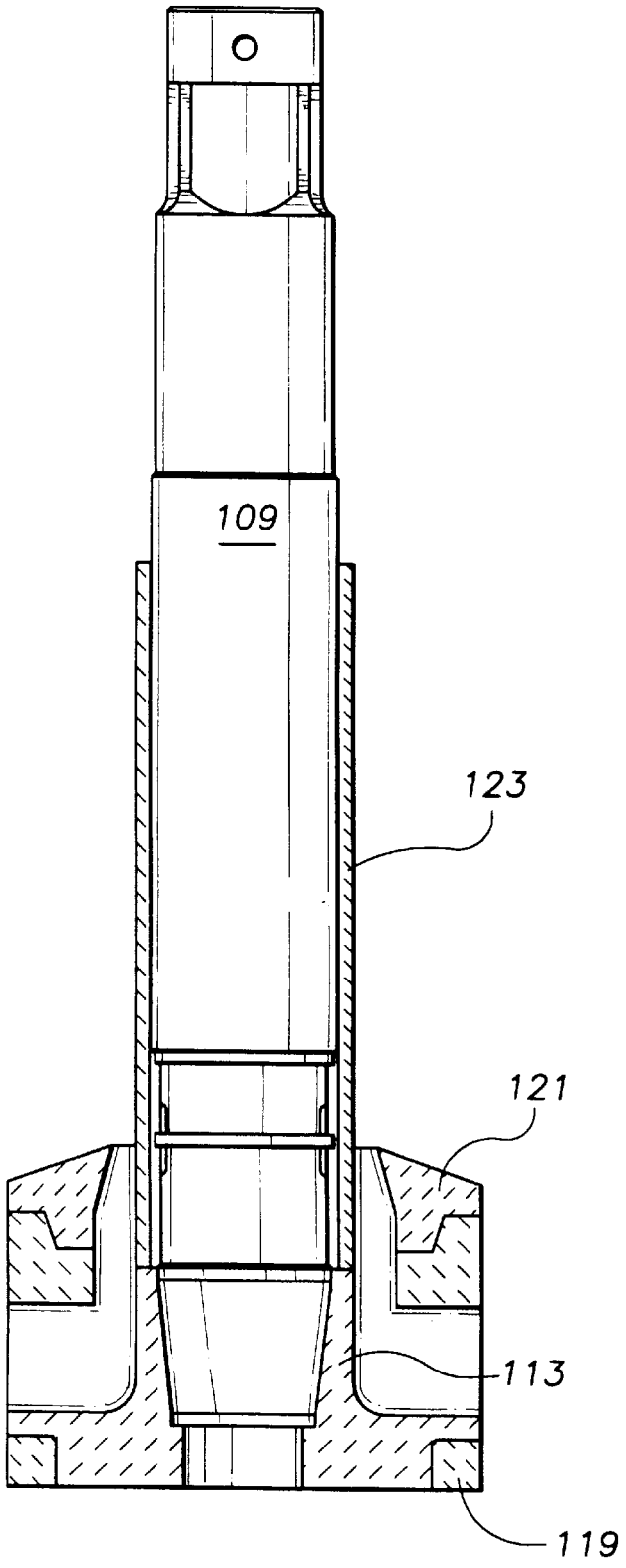
FIG. 11 is a cross-sectional view of the inventive impeller of FIG. 7.
Figure 12:
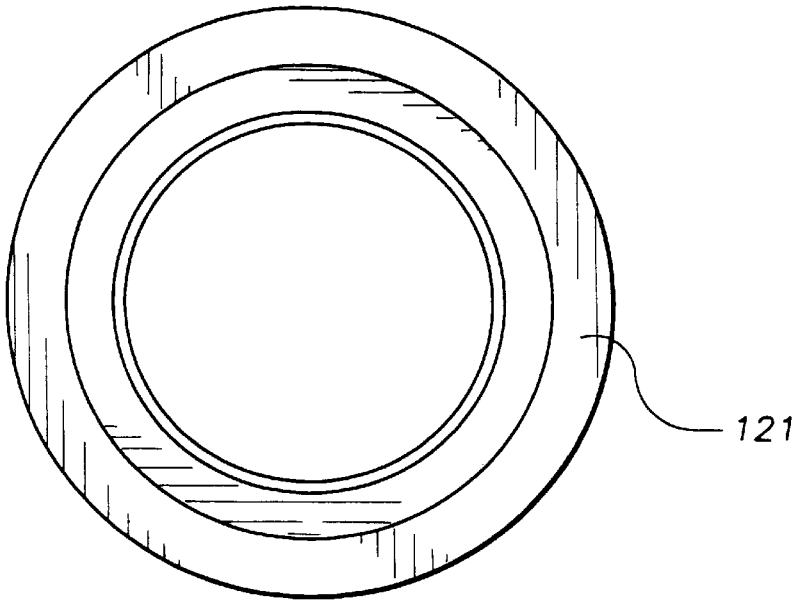
FIG. 12 is a top plan view of the ceramic cap member.

As most clearly seen in FIG. 11, the shaft assembly 109 is preferably provided with a diameter equivalent to that of the column 113 or, and as illustrated, is outfitted with a sheath member 123 to protect the shaft material and provide a consistent dimension with column 113 for effective mating of these two compounds.

It has been found that the impeller design of FIGS. 7–11 is particularly effective in expelling large occlusions in the molten metal bath away from the impeller shaft arrangement and away from the pump housing. More particularly, it has been found that objects are flung away from the impeller and do not become trapped between the impeller and shaft of impeller and housing—which otherwise results in excessive wear of the apparatus.

Figure 13:
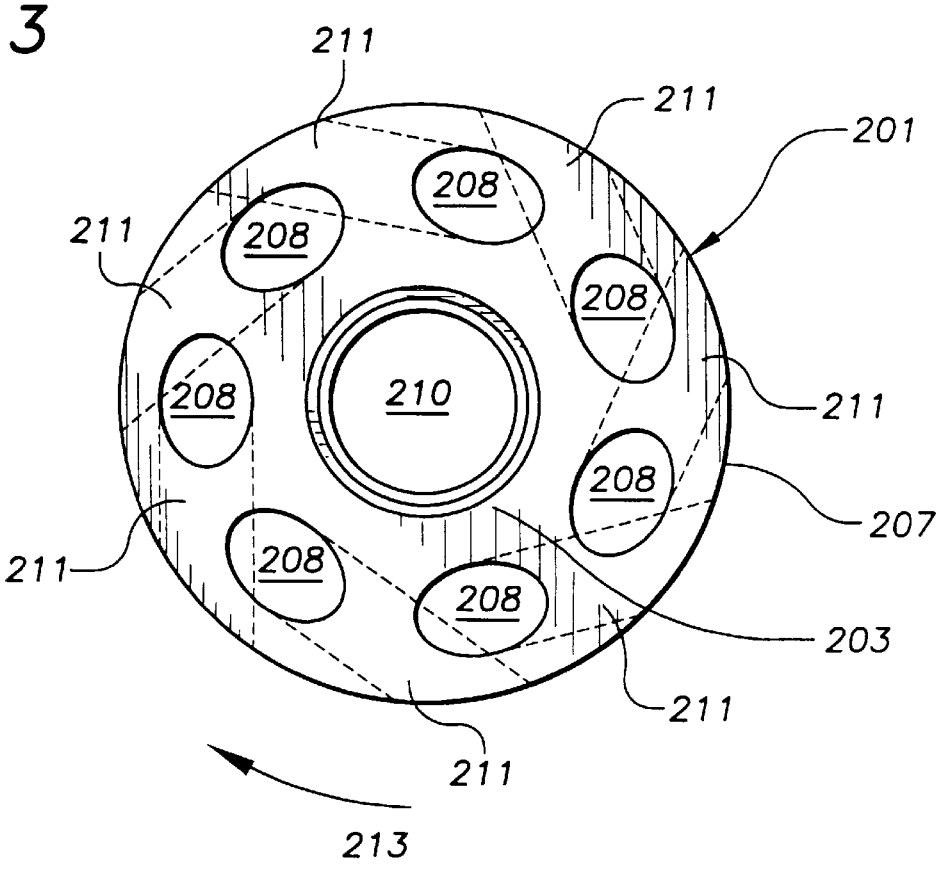
FIG. 13 is a top view of the straight bore embodiment of the inventive impeller.
Figure 14:
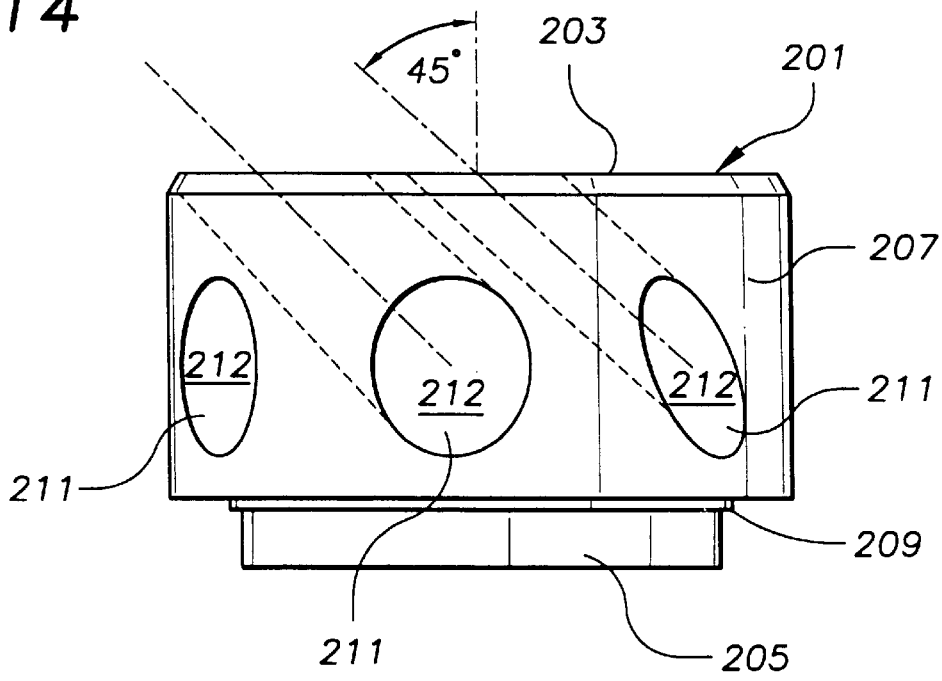
FIG. 14 is a side elevation view of the impeller of FIG. 13.

Referring now to FIGS. 13–14, a further alternative embodiment of the present invention is depicted. Particularly, the inventive impeller 201 is shown comprised of planar top and bottom surfaces 203 and 205, respectively, and a generally circular in cross-section outer sidewall 207. The sidewall 207 does not extend fully to bottom surface 205, but rather a notch 209 is provided to which a bearing ring (not shown) can be affixed in the finished product. A bore 210 is formed in the top surface 203 to accommodate a shaft (not shown).

A plurality of passages 211 are provided. The passages 211 are generally straight bores passing from an inlet 208 in the top surface 203 to an outlet 212 in the sidewall 207. The passages 211 generally have an oval cross-sectional shape and are inclined forwardly from vertical. Particularly, during operation of the pump, the impeller rotation is generally in a direction of arrow 213, from which the reference to forwardly inclined passages is derived. Generally the forward incline will be at least 5°, and preferably about 45° as shown in the figures. Of course, the passages are necessarily angled outwardly from inlet to outlet.

Figure 15:
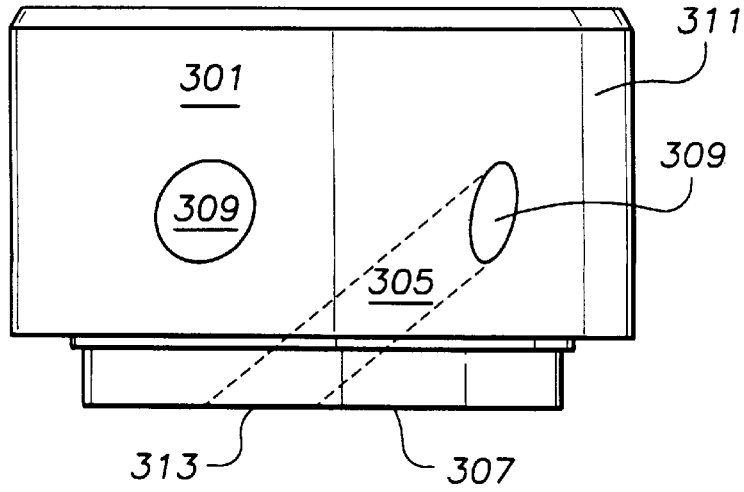
FIG. 15 is a side elevation view of a bottom feed version of the impeller.

Finally, with reference to FIG. 15, a bottom feed impeller 301 is displayed. Moreover, the inlet 313 to the passages 305 is provided in the bottom surface 307 of the impeller 301. Therefore, a plurality of passages 305 are included in this embodiment with outlets 309 being positioned in the sidewall 311 and inlet 313 being provided in the bottom surface 307.

It is also noted that each of the impeller embodiments of this invention, including (i) mated horizontal and vertical passages (FIGS. 1–5), (ii) the annular intake recess (FIGS. 7–12), and (iii) the straight bore passages (FIGS. 13–15), can be advantageously combined and can be used in both top and bottom inlet pumps.

Thus, it is apparent that there has been provided, in accordance with this invention, a molten metal impeller and pump that fully satisfies the objects, aims and advantages set forth above. While the invention has been described in conjunction with specific embodiments thereof, it is evident that many alternatives, modifications, and variations will be apparent to those skilled in the art. In light of the foregoing description, accordingly, it is intended to embrace all such alternatives, modifications, and variations as fall within the spirit and broad scope of the impended claims.

We claim:

1. An impeller for a molten metal pump having a cylindrical body comprised of a refractory material, said cylindrical body including opposed top and bottom surfaces, said cylindrical body further including a bearing element, a means being provided in said top surface for mating with a shaft, a plurality of circumferentially spaced passages extending from said top or bottom surface to a sidewall of said impeller, each of said passages being separate and having an inlet opening in said top or bottom surface and an outlet opening in said sidewall.

2. The impeller of claim 1 wherein said refractory material comprises graphite.

3. The impeller of claim 1 wherein said inlet opening has a cross-sectional area less than each respective said outlet.

4. A molten metal pump including the impeller of claim 1.

5. An impeller for a molten metal pump comprised of a cylindrical refractory body, said cylindrical body having opposed top and bottom surfaces and a radial sidewall, said sidewall including a bearing element, said sidewall providing a substantially contiguous surface interrupted only by a plurality of passages extending from said top or bottom surface to said sidewall, and a means for securing a shaft on said top surface.

6. The impeller of claim 5 wherein said passages are substantially straight.

7. The impeller of claim 6 wherein said passages are generally oval in cross-section.

8. The impeller of claim 6 wherein said passages are inclined at least about 5° from vertical.

9. The impeller of claim 6 wherein said passages are inclined about 45° from vertical.

10. A molten metal pump including the impeller of claim 5.

11. A molten metal pump impeller comprising a cylindrical body of a refractory material, said cylindrical body having opposed generally circular top and bottom surfaces interconnected by a substantially contiguous sidewall, said top surface including a generally centrally located hub or bore, said bottom surface including a plurality of radially disposed inlets, each said inlet forming a fluid communication with a respective passage in said body to a respective outlet positioned in said sidewall, and each said respective inlet having a cross-sectional area equal to or less than each respective said outlet.

12. A molten metal pump including the impeller of claim 11.

13. The impeller of claim 11 wherein each said passage includes an upward section extending from said bottom surface and a horizontal section extending from said sidewall which intersects a respective upward section to form said passage.

14. The impeller of claim 13 wherein said respective horizontal section has a larger diameter than said respective upward section.

* * * * *